United States Patent [19]

Benson et al.

[11] Patent Number: 4,481,515

[45] Date of Patent: Nov. 6, 1984

[54] COORDINATOR FOR TRAFFIC SIGNAL CONTROLLER

[75] Inventors: James A. Benson, Huntingdon Valley; Amadio D. Buccini, Maple Glen, both of Pa.

[73] Assignee: Philmont Electronics, Inc., Philadelphia, Pa.

[21] Appl. No.: 364,296

[22] Filed: Apr. 1, 1982

[51] Int. Cl.[3] ..... G08G 1/07

[52] U.S. Cl. ..... 340/912; 340/333; 340/916; 340/909; 375/108

[58] Field of Search ..... 340/40, 41 R, 35, 46, 340/912, 911, 909, 916, 924, 913, 333, 931; 364/436; 375/108

[56] References Cited

U.S. PATENT DOCUMENTS

| | | | |
|---|---|---|---|
| 2,465,115 | 3/1949 | Pennell | 340/40 |
| 3,252,133 | 5/1966 | Auer | 340/40 |
| 3,594,719 | 7/1971 | Kyoto et al. | 340/40 |
| 3,605,084 | 9/1971 | Matysek | 340/40 |
| 3,816,796 | 6/1974 | Molloy et al. | 315/287 |
| 3,825,890 | 7/1974 | Miyazato et al. | 340/40 |
| 3,893,067 | 7/1975 | Watanabe et al. | 340/46 |
| 4,167,785 | 9/1979 | McReynolds et al. | 364/437 |
| 4,250,483 | 2/1981 | Rubner | 340/40 |
| 4,257,029 | 3/1981 | Stevens | 340/40 |

*Primary Examiner*—James J. Groody

*Attorney, Agent, or Firm*—Caesar, Rivise, Bernstein and Cohen, Ltd.

[57] ABSTRACT

A coordinator for a traffic signal controller having a motor and associated switching system for establishing the duty and width cycle of the controller. The controller being connected, via electrical circuitry, to an AC power grid. The coordinator is a self-contained unit arranged for connection to the controller to effect coordination thereof by producing timing signals in response to receipt of either AC signals from the electrical circuitry or stray AC radiation from adjacent sections of the power grid. The coordinator also includes an independent oscillator for producing independent timing signals. Thus, the coordinator can maintain coordination of the controller under normal operating conditions or under the abnormal operating conditions of a local power failure or a general power failure.

22 Claims, 7 Drawing Figures

COORDINATOR FOR TRAFFIC SIGNAL CONTROLLER

BACKGROUND OF THE INVENTION

This invention relates generally to traffic signal controllers, and more particularly, to coordinators for traffic signal controllers.

Computer based systems have been disclosed in the patent literature for effecting integrated, automatic control of traffic signaling systems. Examples of such computer based traffic control systems are shown in U.S. Pat. Nos. 3,605,084 (Matysek), 3,816,796 (Molloy et al), 3,893,067 (Watanabe et al), 4,167,785 (McReynolds et al) and 4,257,029 (Stevens).

Traffic control in many places in this country is not accomplished through any integrated computerized system. Rather, in such prior art control systems, traffic light control at each intersection is accomplished, via the use of an individual controller, such as an electromechanical controller. Such controllers basically comprise a motor, such as an AC synchronous motor, for rotating a cam wheel. The cam wheel establishes the time period (duty cycle) for one complete cycle of operation of the associated signals, e.g., one red/yellow/green cycle. Cam keys are arranged to be placed at various peripheral positions on the wheel to rotate with the wheel to sequentially engage associated stationary switches and thereby establish the duration of time for each particular colored signal within the duty cycle. Prior art electromechanical controllers also include synchronizing means, commonly in the form of a cam key located on the wheel for establishing a synchronizing signal once each duty cycle.

In order to coordinate the individual controllers in an area, the controllers are manually adjusted so that each controller synchronizing signal is produced at the same time, irrespective of the point at which that signal is produced in the duty cycle. For example, if there are controllers for traffic lights along a through-street, the synchronizing signals are arranged to be produced in unison by the controllers along the length of the street but with corresponding points in the duty cycle being offset or delayed by a predetermined amount at each successive controlled intersection so that traffic along the street can move at a desired speed without stoppage.

As will be recognized by those skilled in the art, electomechanical controllers exhibit a tendency to become unsynchronized due to various factors, e.g., variations in frequency of AC power supply, variations in temperature dependent components, mechanical slippage, etc. One major significant problem regarding synchronization of traffic controller arises in the event of a local power failure, that is where only certain intersections become blacked out. In such an event, when power is restored the traffic lights that were blacked out necessarily oome back on at the point at which power was lost, whereas those lights which did not lose power (and thus continued to run during the power outage) will thus be out of synchronization with the lights which come back on.

In order to resynchronize individual traffic controllers which are not part of an integrated system, it has heretofore been necessary to manually go to each controller box and readjust or reset the motor and the associated cam wheel. Needless to say, such action is expensive, time-consuming and generally unacceptable.

Systems have been described in the patent literature for coordinating traffic controller through the use of transmitted radio receivers from a central location. Examples of such systems are shown in U.S. Pat. Nos. 3,594,719 (Kyoto), 3,825,890 (Miyazato et al) and 4,250,483 (Rubner).

While prior art automated or integrated systems for controlling and coordinating traffic signals, via electrical connection to a central computer or via, transmitted radio signals, are generally suitable for their intended purpose, they nevertheless exhibit one or more of the following disadvantages, e.g., complexity, cost, inability to be retrofitted into existing traffic control systems, etc.

OBJECTS OF THE INVENTION

Accordingly, it is a general object of the instant invention to provide a coordinator for a traffic system which overcomes the disadvantages of the prior art.

It is a further object of this invention to provide a coordinator for a traffic signal controller which maintains synchronization of the controller under various operating conditions.

It is a further object of this invention to provide a coordinator for a traffic signal controller which maintains synchronization during periods of loss of electric power to the controller.

It is a further object of this invention to provide a coordinator for a traffic signal controller which effects synchronization based on the frequency of the AC power provided to the controller.

It is still a further object of this invention to provide a coordinator which is simple in construction, low in cost, and can be readily adapted for use with conventional traffic signal controllers for effecting the synchronization thereof.

These and other objects of the instant invention are achieved by providing a coordinator for a traffic signal controller having motor means and associated switching means for establishing the duty cycle of the controller, with the controller being powered by AC power mains connected to an electric power grid. The coordinator comprises detection means and coordinating means responsive thereto. The coordinator produces a synchronizing signal and provides the same to the motor means and associated switching means during each duty cycle and in synchronization with the frequency of the alternating current provided to the controller by the AC mains. The detecting means comprises means for receiving AC signals from the mains and for receiving stray radiation having a frequency component of the frequency of the AC signal appearing on the power grid and for providing timing signals to the coordinating means. The coordinating means operates in response to the timing signals to produce the synchronizing signals based on the timing signals.

Other objects and many of the attendant advantages of the instant invention will be readily appreciated as the same becomes better understood by reference to the following detailed description when considered in connection with the accompanying drawing wherein:

Figure 1:
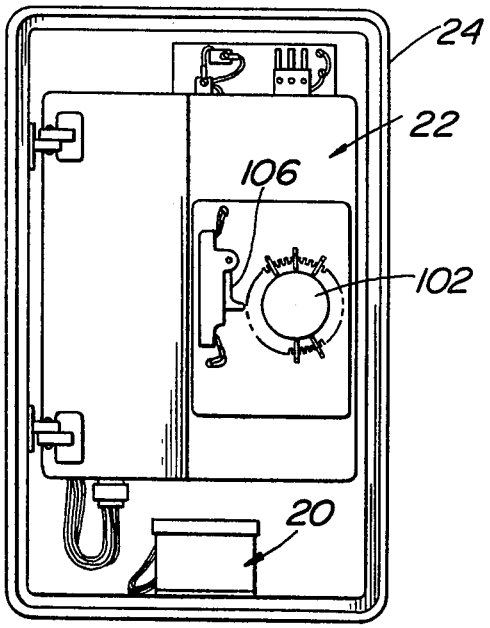
FIG. 1 is a front elevational view of a conventional electromechanical traffic signal controller having a housing or box in which a coordinator 20 constructed in accordance with this invention is located.

Referring now to the various figures of the drawing wherein like reference characters refer to like part, there is shown at 20 in FIG. 1 a coordinator constructed in accordance with the instant invention and adapted to be located within the cabinet or box 24 of a conventional, electromechanical traffic signal controller 22.

Figure 2:
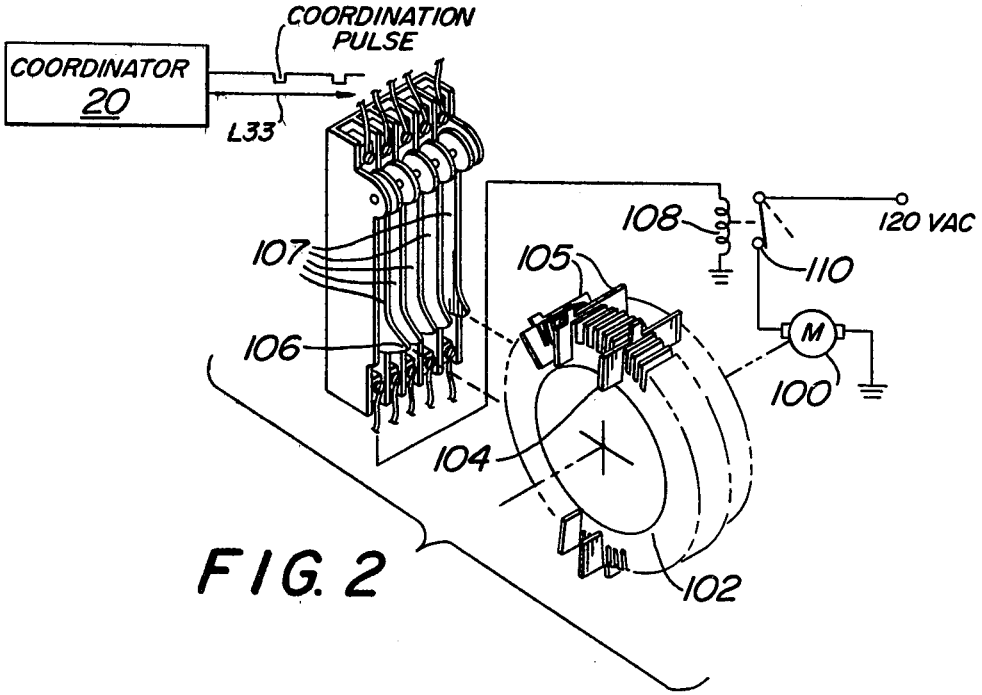
FIG. 2 is a partial schematic, partial perspective view of a portion of the controller shown in FIG. 1 connected to the coordinator of this invention.

In FIG. 2 there is shown a portion of the electromechanical traffic light controller 22. The controller is used to cycle the traffic lights at an intersection through a prescribed color sequence (e.g., red-yellow-green).

The controller basically comprises a synchronous motor 100 for rotating a cam wheel 102. The time for completion of one revolution of the wheel establishes the duty cycle of the controller, i.e., the time it takes to complete one red-yellow-green sequence. In conventional practice, such times can be from 30 to 120 seconds. The duration of each color in the sequence is established by the location and spacing of associated cam keys 105 on the wheel 102. The cam keys are arranged to contact associated control switches 107 for controlling the illumination of the associated lamp colors as the wheel is rotated.

A synchronization cam key 104 is also located on the wheel 102. The synchronizing cam key is arranged to contact an associated coordinating control contact 106 once during each operating cycle.

The synchronizing cam keys of all the controllers 22 in an area should all make contact with their associated control contacts at the same moment in time in order to keep the traffic lights in the area coordinated. Even though all of the synchronizing cam keys should reach associated control switches in unison, such cam keys are typically located at different peripheral positions on the wheel of each controller so that there is an offset or delay in the start of the operational sequence for different intersections. For example, controllers along a main street can be set so that there is a ten second delay between successive intersections in the interest of keeping traffic flowing at a desired speed. In such an application, the coordinating key in each controller is offset by a position corresponding to a ten second delay from the preceding intersection controller.

Conventional electromechanical controllers also include a reset relay having a coil 108 which is connected to the coordinating cam control contact 106 and which also includes contacts 110 connected to the AC power lines for the motor 100. The reset relay is arranged to enable the manual coordination of the controller by interrupting operation of the motor when desired.

The coordinator 20 of the instant invention is a small, self-contained unit which is arranged to be disposed within the cabinet of the controller 22 and connected to the coordinating cam control contact 106 to automatically coordinate the controller 22. The coordinator 20 uses the frequency of the voltage on AC power grid as its synchronization standard, even in the event of a power failure. In this regard in normal operation the coordinator is connected to the AC power line and provides a synchronization signal once each operating cycle. In the event of a local power failure, that is a failure in which only certain areas are blacked out while other areas remain on, the coordinator is arranged to pick up, via an antenna, stray radiation having a component of the frequency of the AC on the power grid from any remotely operating power grid. That stray radiation signal is then utilized as the synchronization standard. In the event of a total power failure (i.e., the entire grid being off) or a failure to pick up sufficient power frequency radiation from the grid, the coordinator includes a crystal oscillator based generator for producing a timing signal at the synchronization standard frequency.

Operation of the coordinator during a local power failure condition is as follows: In the event of a power failure in an area in which a coordinator equipped controller is located, the interruption of the 60 Hz AC power causes the controller's motor 100 to stop and the traffic lights go out. The coordinator also includes self-contained power means, e.g., batteries, for maintaining its operation. The coordinator picks up the stray 60 Hz radiation from the adjacent operating power grid and uses that signal as the synchronization base to provide a coordinated or synchronized output signal.

The details of the coordinator 20 will be described later, suffice for now to state that it includes an output line L33 which is connected to one side of the synchronizing control contact switch 106 of the controller. The other side of the switch 106 is connected to one side of the reset relay coil 108. The other side of reset relay coil 108 is connected to ground. The asociated contacts 110 of the reset relay are connected in the AC power line of the motor 100.

All the time that the power is interrupted to the controller 22, the coordinator continues to operate on its battery back-up in synchronism with the stray 60 Hz radiation picked up by its antenna thereby maintaining synchronization with the power grid. When the power is restored, motor 100 commences operation, thereby operating the cam wheel 102. When the cam wheel coordinating key 104 contacts its associated oontrol switch 106, it closes that switch. If the coordinator 20 is not at the synchronization point in the duty cycle 120 volts AC will exist on its output line L33. That signal is thus applied via the closed control switch 106 to the coil 108 of the reset relay. This action energizes the relay, whereupon its associated contacts 110 open (as shown in phantom in FIG. 2) to disconnect the 120 volt AC from the motor 100. Accordingly, the motor stops at that position and the traffic lights connected to the controller stop cycling. When the coordinator reaches the coordination or synchronization point in its duty cycle, the 120 volt signal no longer appears on line L33, whereupon the reset relay 108 relaxes and its contacts 110 close. This restores the AC to the motor so that the motor restarts operation in synchronism with the coordinator. Since the coordinator maintained synchronism with the surrounding power grid during the local power failure by virtue of the pick up of the stray 60 hertz radiation (or by its internally generated 60 hertz signal in the event of a total power failure), the controller 22 is now synchronized or coordinated with the other traffic controllers on the grid.

The coordinator 20 is also of considerable utility to maintain the synchronization of the controller with the power grid on a long term basis. In this regard, in the event that a controller does attempt to get out of synchronization with the power grid, then the 120 volt AC signal appearing on line L33 at a time that the coordinating cam is in contact with its control contact 106 will cause reset relay 108 to be energized, thereby interrupting operation of the motor and keeping the motor off until the start of the synchronization signal. Thus, when the synchronization signal as provided by the coordinator starts, the motor is reenergized and by the time that the synchronization signal has ended the motor is fully up to speed and in synchronization with the coordinator.

Figure 3:
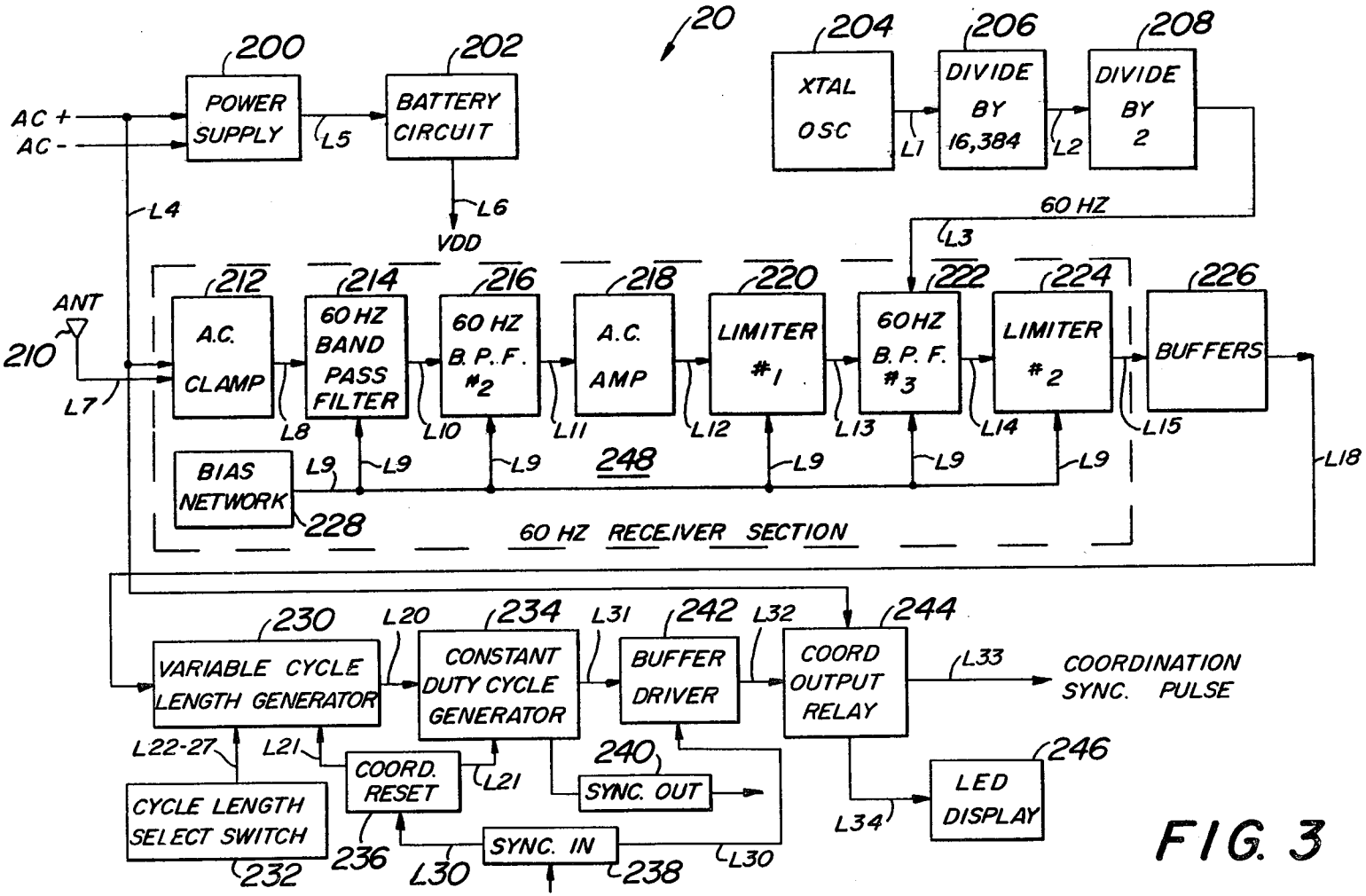
FIG. 3 is a functional block diagram of the components making up the coordinator 20.

Referring to FIG. 3, basic components of the coordinator 20 will be described. To that end, the coordinator 20 basically comprises a power supply 200, a battery circuit 202, a crystal oscillator 204, a divide-by-16,384 circuit 206, a divide-by-2 circuit 208, an antenna 210, an AC clamp 212, a first 60 Hz band pass filter 214, a second 60 Hz band pass filter 216, an AC amplifier 218, a limiter 220, a third 60 Hz band pass filter 222, a second limiter 224, a buffer circuit 226, a bias network 228, a variable cycle length generator 230, a cycle length select switch 232, a constant duty cycle generator 234, a coordinator reset circuit 236, a synch in circuit 238, a synch out circuit 240, a buffer driver 242, a coordinator output relay 244 and light-emitting diode display 246.

The power supply 200 is connected to the AC power mains to provide normal operating power to the coordinator. The power supply is also connected to the battery circuit 202. The battery circuit, which will be described in detail later, provides the backup power for the system in the event of a power failure and, in addition, also includes means for providing the biasing voltage $V_{DD}$ for the coordinator.

The AC clamp 212, the band pass filters 214, 216, and 222, the limiters 220 and 222, the AC amplifier 218 and the bias network 228 serve as a 60 Hz receiver section 248. The 60 Hz receiver section is arranged to receive a 60 Hz input signal from the AC input lines to the controller as well as 60 Hz signals as picked up by the antenna 210 from the stray electromagnetic radiation of the power grid. As will be described in further detail later, when there is a local power failure, e.g., a failure of the power grid in localized area to disabling the controllers in that area, the stray 60 Hz radiation from an adjacent operating section of the power grid is picked up by the antenna 210 and provided to the receiver section 248 so that the coordinator can bring the associated traffic lights into synchronization once power is restored to the blacked out section of the power grid. Accordingly, when power is restored, the traffic lights come on at the desired synchronization point, with the offset, if any, being the same as before the power interruption.

In the event of a total power failure the coordinator 20 is still operative to maintain coordination. To that end, the coordinator is arranged so that the crystal oscillator and associated divider circuits provide 60 Hz clock signals to the receiver section at all times. The amplitude of the signals is sufficiently low so that the signals derived from the AC input signals or antenna input signals predominate to establish the coordination timing. However, in the event of a total power failure the clock signals from the oscillator and associated divider circuits become the timing signals establishing synchronization.

During normal operation, that is, when the controller is receiving AC power through its mains, the synchronization of the associated lights is carried out by the 60 Hz signal received directly from the AC power lines. Since the voltage on the AC power lines is 120 volts AC, whereas the voltage appearing at the antenna 210 is considerably less, the AC clamp circuit 212 is provided to clamp the input voltage from the AC lines during normal operation to a low level, e.g., 1.4 volts peak-to-peak, for use by the remaining circuitry of the receiver section 248. Details of the AC clamp will be described later.

The AC clamp is connected as the input to the 60 Hz band pass filter 214. Another input to the band pass filter 214 is provided by the bias network 228. The bias network provides the appropriate bias voltage, e.g., 2.5 volts, to all of the circuitry of the receiver section.

The output of the AC clamp is provided as an input to the first 60 Hz band pass filter stage 214. This filter stage is an active filter having a relatively high gain, e.g., 200, with a band width of approximately 6 Hz. Owing to the gain, the filter operates in saturation. The 60 Hz output signal from the stage 214 is provided to a second 60 Hz band pass filter stage 216. Stage 216 is also an active filter but has a unity gain with a very narrow band pass, e.g., 2 Hz centered about the band pass of 60 Hz, so that any harmonics generated in the front end of the receiving section are filtered out. The second stage band pass filter 216 is also connected to the bias network for appropriate bias voltage. The output of the second stage band pass filter 216 is connected as an input to the AC amplifier. This amplifier is an active device which amplifies the 60 Hz signal by approximately 30. The amplified signal is then provided as an input to the limiter circuit 220. The limiter circuit is also connected to the bias network 228 for appropriate bias voltage and is arranged to square the 60 Hz sine wave into a square wave of that frequency.

The limiter circuit is also connected to the bias circuit and basically comprises an amplifier stage operating on a minimum threshold level to square the input sine wave above the threshold level. The minimum threshold level is provided so that the crystal oscillator can provide the 60 Hz timing signals for effecting coordination in the event that the 60 Hz signal provided by the AC amplifier is below that threshold level (which action could occur in the event of a total power failure or in any other condition in which the signal strength of stray 60 Hz radiation is too low to be utilized effectively).

The 60 Hz square wave from the limiter is provided to a third stage band pass filter 222. This filter is an active filter having a unity gain and a band width of 2 Hz. Two inputs are provided to this filter, namely, the 60 Hz signals from the limiter 220 and the 60 Hz clock signals from the crystal oscillator and associated divider circuits.

The third stage band pass filter is also connected to the bias network 28. In the event that there is a 60 Hz output from the limiter 220, that signal is of greater magnitude than the 60 Hz clock signal provided by the crystal oscillator and the associated divider circuits. Thus, the 60 Hz signal from the limiter 220 predominates and is used to establish the synchronization signals. To that end, the 60 Hz signal from the limiter is filtered further by the third stage band pass filter 222 to get rid of any harmonics and to insure that there is a 50/50 duty cycle.

The output of the band pass filter is provided to the second limiter 224. The limiter 224 is also an active device which is connected to the bias network 228 and serves to sharpen up the square wave for a faster rise and fall time.

The output of the limiter circuit 224 is provided as an input to the buffer circuit 226. This circuit is provided to reduce the rise and fall time of the signal provided by the receiver section 248, and also to provide convenient means, as will be described later, for introducing external reference signals used to automatically test the coordinator 20 during its manufacture.

The 60 Hz signal from the buffers 226 are provided to the input to the variable cycle length generator 230. The cycle select length switches 232 are coupled to the variable cycle lengh generator and operate in conjunction therewith to establish the length of one complete cycle of operation of the traffic light controller. While most traffic systems use timing cycles in the rage of 30–120 seconds, the cycle length select switch and cooperating variable cycle length generator of the coordinator 20 provide operational cycles from 5–320 second in five second increments.

During the manufacture of the coordinator 20, it is necessary to determine proper operations for each length operating cycle. The use of a 60 Hz input signal to the variable cycle generator 230 renders such testing necessarily slow. Accordingly, the buffer circuit 226 is provided to enable a much higher frequency input signal, e.g., 100 KHz., to the variable cycle length generator input, as will be described later.

In operation in the field, the cycle lengh select switches are set to provide the proper duration cycle of the controller. For example, if the traffic light at a particular intersection is to cycle through one complete cycle of operation in 60 seconds, then the cycle length select switch 232 is set to establish a 60-second duration time cycle.

The output from the variable cycle length generator is provided as an input to the constant duty cycle generator and comprises, depending on the switch settings, a digital signal having a 50-50 duty cycle frequency varying from 30 Hz to 30/64 Hz. Thus, the variable cycle length generator serves to divide the 60 Hz input signal down to a repetition rate which is consistent with the cycle time of the light controller at the intersection. This output signal is then provided to the constant duty cycle generator circuit 234. The constant duty cycle generator is arranged to establish a preselected constant duty cycle, e.g., 3.3% on and 96.7% off +/−1%, irrespective of the frequency of the signal provided from the variable cycle length generator 230. By dividing the input signal into a 3.3% "on" portion and a 96.7% "off" portion, the constant duty cycle generator circuit 230 establishes the time period during which the coordination or synchronization signal is provided to the controller to synchronize its lights. To accomplish this, the constant duty cycle generator counts the input signals from the variable cycle length generator to establish the on/off duty cycle and provides an output signal during the "on" period to the buffer driver 242.

The buffer driver basically comprises an amplifier that amplifies the output signal from the constant duty generator during its 3.3% "on" time and provides it to the coordinating output relay 244. This signal is used to control the energization and de-energization of the relay 244. To that end, the relay is arranged to provide a 120 volt AC output during the 96.7% portion of the buffer driver output signal and no voltage during the 3.3% portion. It is the absence of the 120 volt AC signal during the 3.3% portion of the duty cycle that serves as the coordination or synchronization signal for coordinating the traffic light controllers. In particular, if the "on" time does not occur at a proper point in time, the resulting 120 volt AC signal that is provided by the relay causes the reset relay 108 to open to de-energize the motor and thus cause the the traffic light controller to stop. As soon as the "on" signal is detected, the synchronous motor restarts. Thus, all traffic light controller in the traffic network maintain coordination since coordination output signals (pulses) occur at the same time.

Referring now to FIGS. 4A, 4B, 4C and 4D, the details of the circuitry making up the coordinator will be considered.

The crystal oscillator circuit 204 basically comprises a crystal Y1 having one side connected to the common junction of a capacitor C1 and a variable capacitor C2 and its other side connected to one side of a capacitor C3. The capacitors C1, C2 and C3 are connected together to ground. The common junction capacitor C1 and C2 is connected to one side of a resistor R1. The other side of resistor R1 is connected to the junction of crystal Y1 and a capacitor C3 and to one side of a resistor R2. The common junction of resistor R1 and capacitor C1 and C2 is connected to pin 9 of one stage I6-1 of a six stage integrated circuit inverter. The inverter is of conventional construction, such as sold by Motorola as Model 14069. The output pin 8 of the inverter I6-1 is connected to the other side of resistor R2 and to input pin 11 of the second stage I6-2 of the inverter. The output pin 10 of the stage I6-2 is connected to a line L1 which serves as the input to the divide-by-16,384 circuit 206. The capacitors C1, C2 and C3 and the resistors R1 and R2 provide a feedback network to tune the crystal oscillator to the desired frequency, while the inverters provide buffering to prevent the loading of the crystal. The output frequency of the crystal oscillator, as provided on line L1 is a frequency of 1.966 MHz. This signal is provided via line L1 to pin 10 of an integrated circuit programmable, divide-by-16,384 counter MD3. Counter MD3 is a conventional device, such as sold by Motorola as Model MC14020. The counter operates to divide the incoming signal appearing on line L1 by 16,384. This signal is provided at the Q14 pin 3 of MD3 and is carried by line L2 to the input of the divide by two circuit 208. The divide by 2 circuit 208 basically comprises an integrated circuit flip flop MD5, of conventional construction, such as sold by Motorola as Model 14013. Pin 11, the input pin of MD5 is connected to line L2. Pins 8 and 10, respectively the set and reset pin of the flip flop MD5, are connected together to ground. Pins 9 and 12 are connected together. Pin 13, which is the Q output of the flip flop is connected to a line L3.

The signal appearing on line L3 is a 60 Hz clock signal provided as one input to the third stage of band pass filter 222. The clock signal, as discussed earlier, is used in the event that the input signal from the limiter is below a predetermined threshold level.

The power supply circuit 200 basically comprises a transformer T1, a diode bridge made up of diodes CR3, CR4, CR5 and CR6, a three terminal, integrated circuit voltage regulator VR and a pair of capacitors C4 and C5. One side of the primary of transformer T1 is connected to the negative AC bus while the other side of the transformer is connected through a fuse F1 to the positive AC bus and to an AC line L4. The secondary of transformor T1 is connected to the common junction of the cathode of diode CR3 and the anode of diode CR4, while the other side of the secondary is connected to the common junction of the cathode of diode CR5 and the anode of diode CR6. The anodes of diode CR3 and CR5 are connected to ground and the cathodes of diodes CR4 and CR6 are connected together to pin 1 of the voltage regulator VR and to one side of the capacitor C4. The other side of capacitor C4 is connected to ground. Pin 1 constitutes the input of the voltage regulator. Pin 3 of the voltage regulator VR is connected to ground. Pin 2, the output pin of the voltage regulator and is connected to one side of the capacitor C5 and to line L5. The other side of capacitor C5 is connected to ground. Line L5 serves as the input to the battery circuit 202. The voltage regulator VR is a conventional 12 volt regulator, such as sold by Fairchild as Model 78L12AlWC and which provides a regulated 12 volts at its output pin 2 for input to the battery circuit.

The battery circuit 202 basically oomprises a diode CR7, a resistor R24, a capacitor C6, a zener diode CR9 and four, series connected 1.2 volt nickel cadmium batteries B. The anode of diode CR7 is connected to line L5 and to one side of resistor R24. The other side of resistor R24 is connected to the plus side of the series connected batteries B, to one side of a capacitor C6, to the cathod of zener diode CR9 and to a line L6. Line L6 provides the bias voltage $V_{DD}$ to the bias network 228. The diode CR7 precludes the batteries from draining when the power supply is interrupted, such as could occur during a power failure. The capacitor C6 serves as a filter capacitor to eliminate noise resulting from high speed switching. The zener diode CR9 serves to clamp the voltage $V_{DD}$ at 6.2 volts.

The construction of the battery circuit is such that a positive flow of current is produced at all times that AC is provided to the controller. In this regard, the amount of current provided to the battery circuit from the power supply is in excess of that necessary to keep the batteries at full charge. Thus, the bias voltage $V_{DD}$ remains constant with the batteries effectively acting as a regulator for the DC bias voltage.

The AC clamp circuit 212 basically comprises a resistor R4 and a pair of diodes CR1 and CR2. In particular one side of resistor R4 is connected to line L4. The other side of resistor R4 is connected to the common junction of a line L7 (which is connected to the antenna 210 of the anode of diode CR1, the cathode of diode CR2 and to an output line L8. The cathode of diode CR1 and the anode of diode CR2 are connected together to ground. Resistor R4 serves as a current limiting resistor, while the back-to-back diodes CR1 and CR2 provide clamping means to limit the AC voltage to a sufficiently low level, e.g., $+/-\frac{1}{2}$ vac in the event of normal operation, that is when there is AC on line L4.

Line L8 serves as the input to the first band pass filter 214. This filter basically is a multiple feedback buffered device which comprises resistors R3, R5 and R6, capacitors C8, C9 and C10 and one stage IC8-1 of a quad or four stage, integrated circuit, operational amplifier. That amplifier is a conventional device, such as sold by National Semiconductor as Model LM324. One side of the resistor R3 is connected to ground, while the other side is connected to one side of the capacitor C8 and to one side of the capacitor C9. The other side of capacitor C9 is connected to inverting input pin 9 of IC8-1 and to one side of the resistor R5. The other side of resistor R5 is connected to the junction of the other side of capacitor C8 and the output pin 8 of the amplifier IC8-1. Input line L8 is connected to one side of capacitor C10. The other side of capacitor C10 is connected to the non-inverting input pin 10 of the amplifier IC8-1 and to one side of the resistor R6. The other side of resistor R6 is connected to line L9. Line L9 is the output line from the bias network 228. Resistors R3 and R5 and capacitors C8 and C9 establish the frequency of the band pass filter, with resistor R6 setting the input and biasing the front end of the filter a little less than halfway between $V_{DD}$ and ground. Capacitor C10 serves as a coupling capacitor.

The bias network basically comprises a pair of resistors R27 and R28, a capacitor C11 and another stage of the quad integrated circuit, operational amplifier, namely, stage IC8-2. One side of resistor R27 is connected to the line L6 providing the $V_{DD}$ bias voltage from the battery circuit 202. The other side of resistor R27 is connected to one side of capacitor C11, to one side of resistor R28 and to the non-inverting input pin 12 of the IC8-2. The other side of capacitor C11 is connected to ground and the other side of resistor R28 is connected to ground. The inverting input pin 13 of the IC8-2 is connected to its output pin 14 and to line L9. The bias network serves to roughly divide $V_{DD}$ in half (actually slightly on the negative side) with the resistors R27 and R28 acting as a voltage divider. The bias network is a high impedence network which draws very little current from the battery circuit, via line L6. The operational amplifier IC8-2 is set as a voltage follower so that the output voltage appearing on line L9 closely follows the voltage appearing on pin 12. Capacitor C11 serves as a noise suppression capacitor.

The input to the second stage band pass filter 216 is provided via line L10. The second stage band pass filter basically oomprises resistors R7, R8, R10 and R11, potentiometer R9, capacitor C12 and C13 and a third stage of the quad, integrated circuit operational amplifier, namely, stage IC8-3. Line L10, the input line to the band pass filter 216 is connected to one side of the resistor R7. The other side of resistor R7 is connected to one side of a resistor R8 and to one side of capacitor C12 and one side of capacitor C13. The other side of resistor R8 is connected to the common point of one side of a potentiometer R9 and its wiper arm. The other side of the potentiometer R9 is connected to ground. The other side of capacitor C13 is connected to the inverting input pin 6 of the operational amplifier IC8-3 and to one side of a resistor R11. The other side of resistor R11 is connected to one side of a resistor R10. The other side of resistor R10 is connected to the other side of capacitor C12 and to the output pin 7 of IC8-3. Pin 4 of IC8-3 is connected to the bias voltage $V_{DD}$ while pin 11 is connected to ground. The non-inverting input pin 5 of the operational amplifier OA8-3 is connected to line L9 from the bias network 228. The resistors R7 and R8 and potentiometer R9 perform a similar function to resistor R3 of the band pass filter circuit 214. In particular resistor R9, in combination with resistor R8, establishes the exact 60 Hz band pass frequency of the filter 216. The capacitor C12 and C13 and resistors R10 and R11 operate in the conventional manner as the frequency determining components of the filter 216. The output pin 7 of the operational amplifier IC8-3 is connected to a line L11 which serves as the input to the AC amplifier circuit 218.

The AC amplifier circuit 218 basically oomprises resistors R12, R13 and R14, capacitor C14 and the fourth stage IC8-4 of the quad, integrated circuit operational amplifier. The input line L11 is connected to one side of the resistor R13. The other side of resistor R13 is connected to the non-inverting input pin 3 of IC8-4. The inverting input pin 2 of IC8-4 is connected to the common junction of one side of resistor R12 and one side of a resistor R14. The other side of resistor R14 is connected to the output pin 1 of IC8-4 and to an output line L12. The other side of resistor R12 is connected to one side of a capacitor C14. The other side of capacitor C14 is connected to ground. Resisitors R12 and R14 determine the gain of the AC amplifier 218, while capacitor C14 supplies an AC ground for the input. The resistor R13 provides current limiting action.

The first stage limiter circuit 220 basically comprises resistors R15, R16 and R17 and one stage IC9-1 of a four stage, integrated circuit operational amplifier. The operational amplifier is a conventional device, such as sold by National Semiconductor as Model LM324. Input line L12 to the limiter circuit 220 is connected to one side of a resistor R15. The other side of resistor R15 is connected to the inverting input pin 13 of operational amplifier IC9-1. The output pin 14 of IC9-1 is connected to line L13 and one side of resistor R17. The other side of resistor R17 is connected to the non-inverting input pin 12 of IC9-1 and to one side of resistor R16. The other side of resistor R16 is connected to line L9 from the bias network 228.

The limiter is arranged to provide a 60 Hz square wave on L13. To that end the resistor R15 serves as a current limiting resistor and R17 serves as a feedback resistor between the output pin and the non-inverting input pin. Resistors R16 and R17 together create a voltage divider, e.g., a 10-to-1 divider, thus before the operational amplifier can switch states between plus and minus voltage, to produce the square wave output, the signal appearing on pin 13 must exceed the offset as provided by feedback resistor R17.

The third stage band pass filter circuit 222 basically comprises resistors R18, R19, R21, R22 and R41, a potentiometer R20, capacitors C15 and C16 and a second stage operational amplifier IC9-2 of the quad integrated circuit operational amplifier. One side of resistor R18 is connected to input line L13 and the other side is connected to the common juncture of one side of resistor R41, one side of resistor R19, one side of capacitor C16 and one side of capacitor C15. The other side of resistor R41 is connected to line L3 from the divide by two circuit 208. The other side of resistor R19 is connected to the common junction of one side of potentiometer 120 and its wiper arm. The other side of potentiometer R20 is connected to ground. The other side of capacitor C16 is connected to the common junction of inverting pin 2 of IC9-2 and to one side of the resistor R22. The other side of resistor R22 is connected to one side of the resistor R21. The other side of resistor R21 is connected to the other side of capacitor C15 and to output pin 1 of IC9-2. Pin 1 is also connected to line L14, the output line of the third stage band pass filter. The non-inverting input pin 3 of the IC9-2 is connected to L9 from the bias network.

The third stage band pass filter 222 is very similar in construction to the band pass filter 216 and operates in a similar manner thereto, except that an additional input to the band pass filter 222 is provided, via resistor R41 from the crystal oscillator and the associated divider circuits. Thus, the 60 Hz clock signals produced from the crystal oscillator are provided, via resistor R41 to the junction of resistors R18 and R19. In either operational condition in which the limiter provides a 60 Hz square wave on line L13 (e.g., the conditions when the power on the mains or else where there is a power failure but the failure is localized and the antenna can pick up sufficient stray 60 Hz radiation to produce the 60 Hz signal at L13), the 60 Hz signal provided at R18 greatly exceeds the 60 Hz clock signals produced from the oscillator. Thus, the power grid originated 60 Hz signal is used during all normal or local power failure operations.

The 60 Hz squarewave signal provided by the third stage band pass filter circuit 222 appears on line L14 and serves as the input to the second stage limiter 224.

The second stage limiter 224 basically comprises resistor R23 and the third stage operational amplifier IC9-3 of the quad operational amplifier. The resistor R23 is a current limiting resistor. Since there is no feedback resistor for IC9-3 it operates in an open loop to provide a square wave output for a sine wave input. Thus, the second stage limiter 224 acts as a zero crossing detector. The output line L15 of the second stage limiter serves as the input to the buffer stage 226.

The primary function of the buffer stage, as noted heretofore, is to facilitate production testing of the coordinator 20. The buffers basically comprise a pair of resistors R29 and R30 and two NAND gates stages MD7-1 and MD7-2 of a quad NAND gate, integrated circuit. The integrated circuit is of conventional construction, such as sold by Motorola as Model 14011. Line L15 is connected to pin 5 of a NAND gate MD7-1. The other input pin of NAND gate MD7-1, that is pin 5, is connected to one side of resistor R29 and to a line L16 terminating at a test point TP2 in the cycle length select switch, to be described later. The other side of resistor R29 is connected to the $V_{DD}$ bias voltage. The output pin 4 of NAND gate MD7-1 is connected to input pin 2 of NAND gate MD7-2. The other input to NAND gate MD7-2, that is pin 1, is connected to one side of resistor R30 and to a line L17. Line L17 is connected to a test point TP1 also in the cycle length select switch. The other side of resistor R30 is also connected to the bias voltage $V_{DD}$. Pin 7 of the MD7-2 is connected to ground while its pin 14 is connected to the bias voltage $V_{DD}$. The output pin of MD7-2, that is pin 3, is connnected to a line L18 which serves as the input to the variable cycle length generator circuit 230.

During operation of the coordinator 20 a 60 Hz square wave is provided on L18 for use by the variable cycle length generator to establish the coordination cycle in response to the settings on the cycle length select switches.

In order to facilitate production testing of the device a microprocessor (not shown) is arranged to be connected to test points TP1 and TP2 in the cycle length select switche to provide a high frequency signal, e.g. 100 KHz, via lines 17 and 18 to buffers. In particular, during testing of the coordinator all of the switches of the cycle length select switch are disconnected and a wiring harness from the microprocessor is connected to the various switch contact points. In addition, the harness is connected to test points TP1 and TP2. Test point TP2 is then grounded to disable NAND gate MD7-1 and thereby prevent the 60 Hz signal appearing on line 15 from passing therethrough. A high frequency clock signal, such as a 100 kilohertz square wave is provided by the microprocessor into test point TP2, whereupon this high frequency signal appears at the output pin 3 of NAND gate MD7-2 for input to the variable cycle length generator. Thus, the variable cycle length generator can be checked at 100 KHz frequency rather than at the 60 Hz normal operating frequency, thereby resulting in a much more efficient test procedure.

The buffer circuit 226 also acts to square up the input signals appearing on L15. However, such operation is not crucial to the operation of the coordinator. Thus, the basic function of buffer circuit 226 in the coordinator is to serve as a convenient production test means.

The variable cycle length generator 230 basically comprises a one-to-sixty four bit variable length shift register MD1. MD1 is a conventional integrated circuit, such as sold by Motorola as Model 14557BCP. The shift register which divides the 60 Hz input signal appearing on line 18 to a signal having a 50/50 duty cycle with the frequency varying from 30 Hz to 30/64 Hz, depending upon the setting of the cycle length select switches 232. The cycle length select switches basically comprise a switch SW1 having six individually bridgable pairs of contacts. To that end one contact of each of the six pairs of contacts making up switch SW1 is connected to the bias voltage $V_{DD}$. The other contact of each of the other pairs of contacts are connected to a respective input pin of the variable cycle length generator. To that end, as can be seen contact 1 of SW1 is connected to pin 2 of the integrated circuit MD1 by line L22. The contact 2 of the switch SW1 is connected to pin 1 of MD1, via line L23. Contacts 3, 4, 5 and 6 of SW1 are connected to pins 15, 14, 13, and 12, respectively of MD1 by lilnes L24, L25, L26 and L27, respectively. Resistors R31, R32, R33, R34, R35, and R36 are connected between pins 12, 13, 14, 15, 1, and 2, respectively, of MD1 and ground to act as terminating resistors for the integrated circuit. Pin 3 of MD1 is the reset pin for the circuit. Pins 4 and 16 are connected together to the bias voltage $V_{DD}$ Pins 7, 8 and 9 are connected together to ground and pin 6 and pin 11 are connected together. Pin 10 is connected to a line L20 which serves as the one input to the constant duty cycle generator circuit 234. Pin 3, the reset pin of MD1, is connected to a line L21. Line L21 is an output line from the coordinator reset circuit 236 and is also connected to one input of the constant duty cycle generator 234.

Figure 4A:
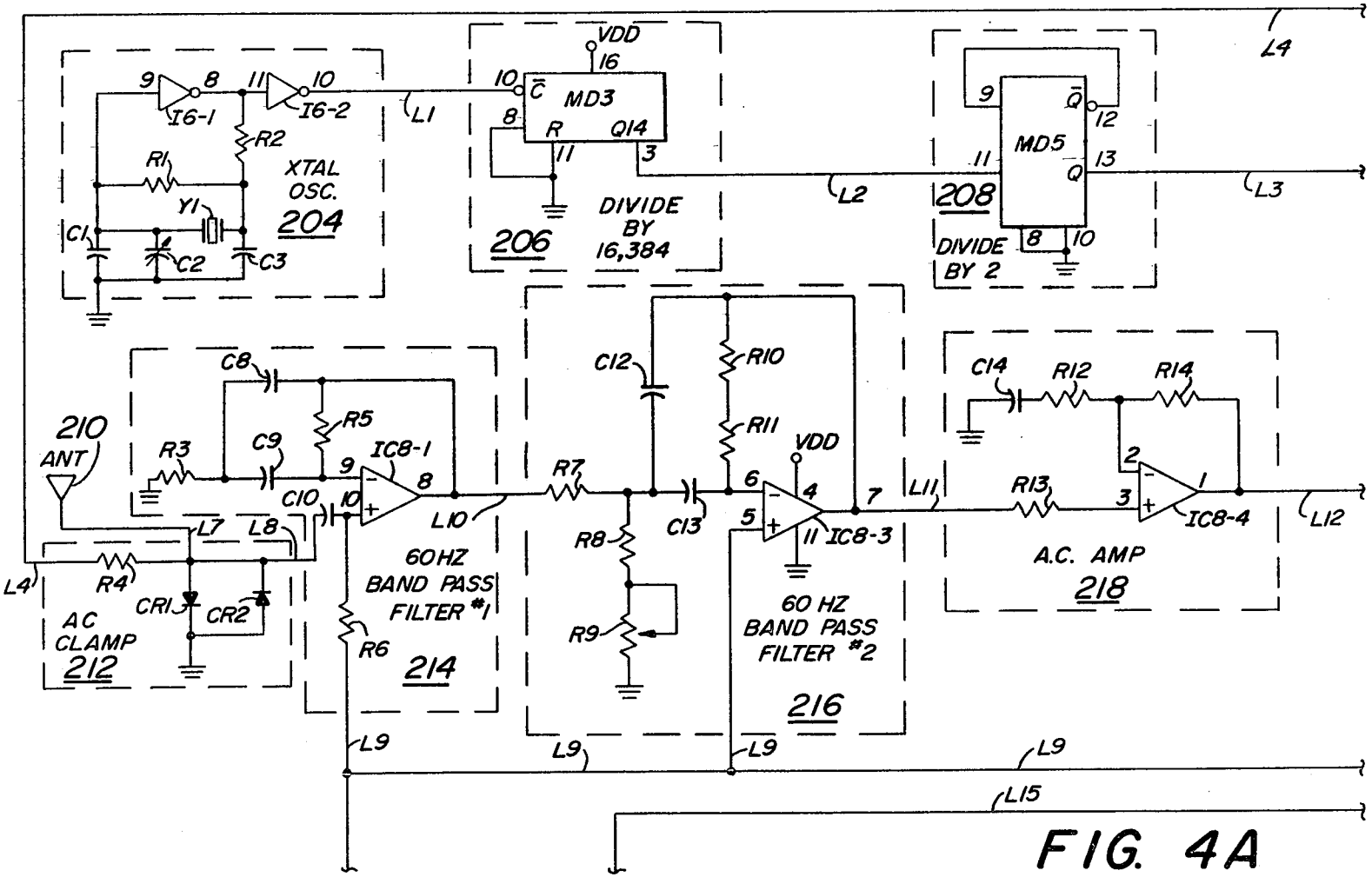
FIGS. 4A, 4B, 4C and 4D are each partial schematic diagrams which collectively comprise a schematic diagram of the coordinator 20.
Figure 4B:
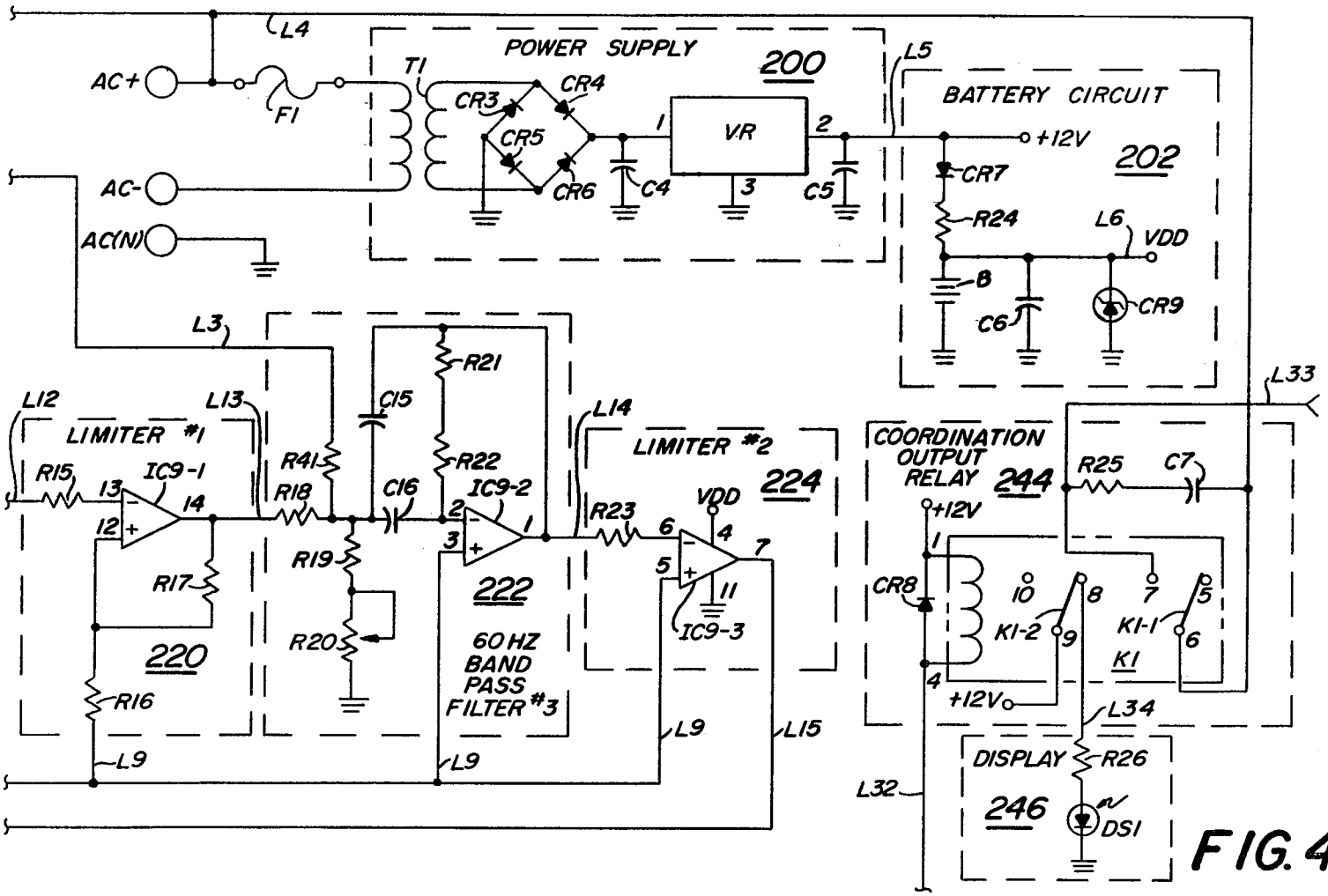
Figure 4C:
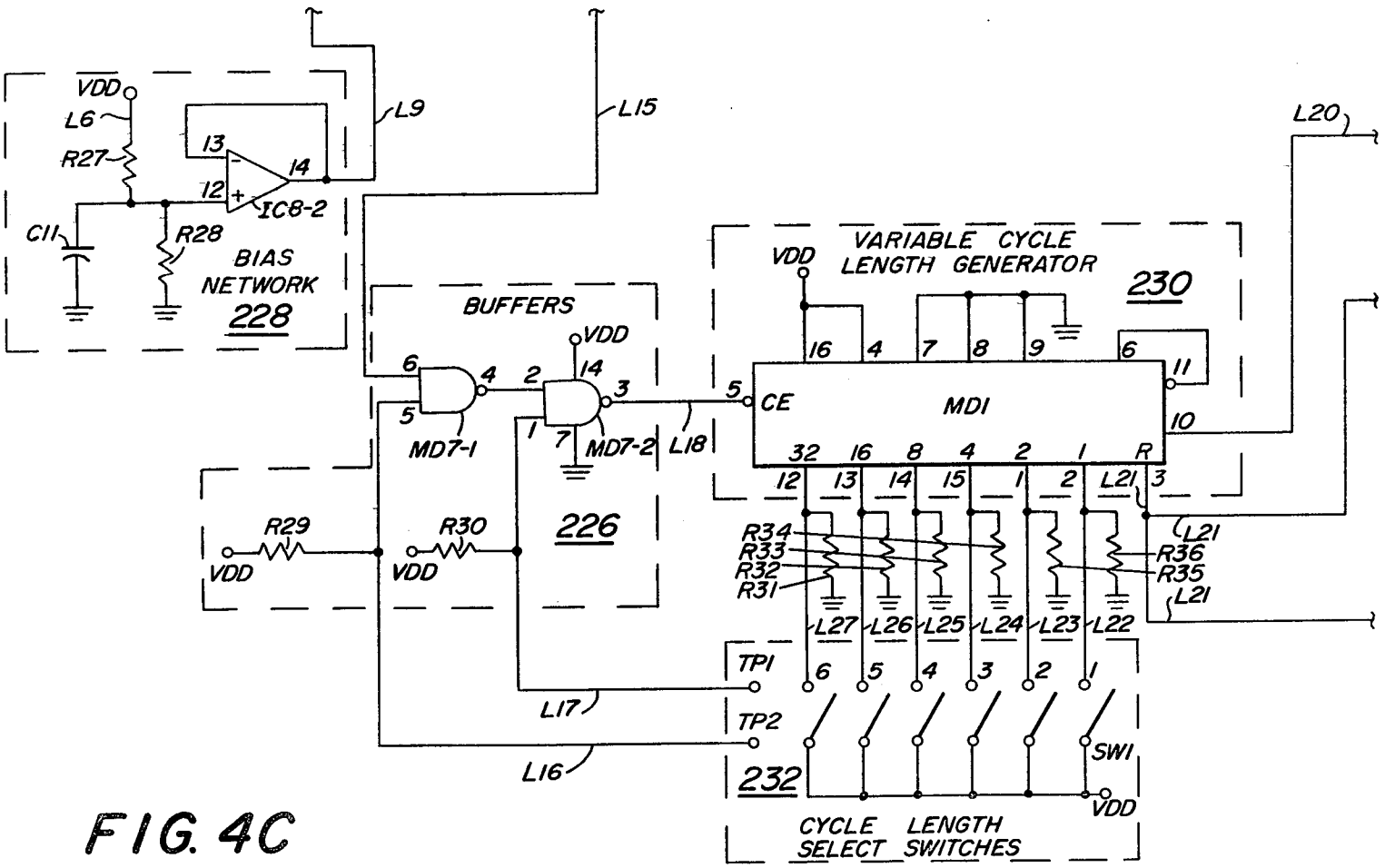
Figure 4D:
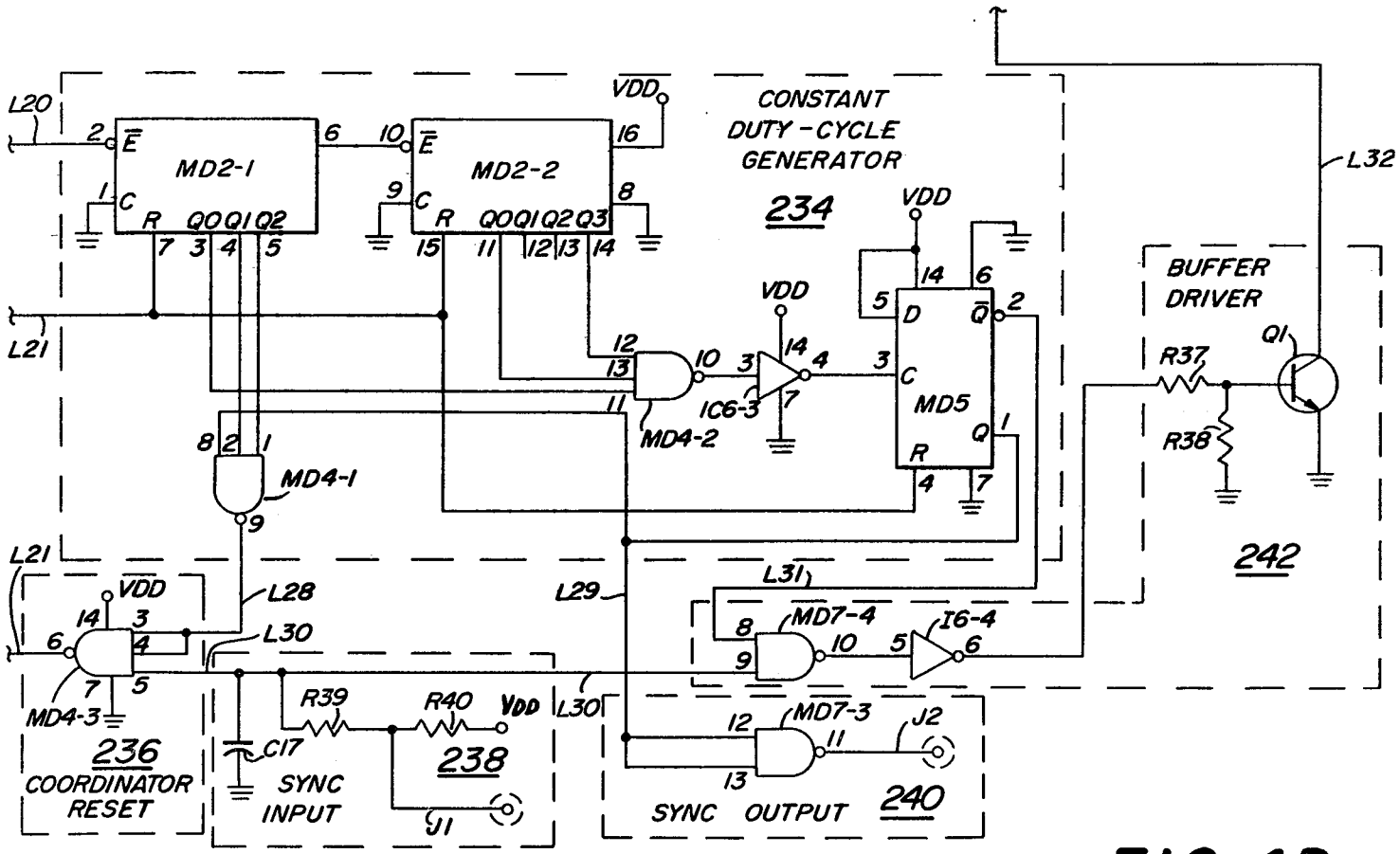

As will be appreciated by those skilled in the art, when all of the switches are in the open position as shown in FIG. 4C the variable cycle length generator acts as a flip flop, thereby dividing the input frequency appearing on line L18 in two. Thus, with a 60 Hz input a 30 Hz output appears on line L20.

The constant duty cycle generator circuit 234 basically comprises two, eight bit binary counters MD2-1 and MD2-2, each of which comprises one stage of a two-stage, integrated circuit counter, two NAND gates MD4-1 and MD4-2, each of which comprises one stage of a quad NAND gate, inverter stage I6-3 of the six stage integrated circuit inverter and a flip flop MD5. The counter composed of MD2-1 and MD2-2 is of conventional construction, such as sold by Motorola as Model 14520. The NAND gates MD4-1 and MD4-2 comprise respective stages of a conventional quad NAND gate integrated circuit, such as sold by Motorola as Model 14023. The flip flop MD5 is a conventional device, such as sold by Motorola as Model 14020. The first stage counter, that is MD2-1, has its input pin 2 connected to line L20 from the variable cycle length generator 230. The clear pin 1 of MD2-1 is connected to ground. The reset pin 7 of MD2-1 is connected to the reset pin 15 of MD2-2 and to line L21 from the coordinator reset circuit 236. Pins 3, 4 and 5 represent the Q0, Q1 and Q2 outputs of MD2-1, respectively. Output pin 6 of MD2-1 is connected to input pin 10 of MD2-2. The clear pin 9 of MD2-2 is connected to ground. Pins 11, 12, 13, and 14 represent the Q0, Q1, Q2 and Q3, respective outputs, of MD2-2. Pin 8 of MD2-2 is connected to ground and pin 16 of MD2-2 is connected to $V_{DD}$.

Two NAND gates MD4-1 and MD4-2 decode the outputs of MD2-1 and MD2-2. Input pins 1 and 2 of MD4-1 are connected to pins 5 and 4, respectively, of MD2-1. Pin 8 of MD4-1 is connected to the Q output pin 1 of the flip flop MD5. The output pin 9 of NAND gate MD4-1 is connected to line L28 which serves as one input to the coordinator reset circuit 236. The input pins 11, 13, and 12 of NAND gate MD4-2 are connected to pin 3 of MD2-1, and pins 11 and 14 of MD2-2 respectively. The output pin of NAND gate MD4-2 is connected to input pin 3 of inverter IC6-3. Pin 14 of the inverter is connected to the bias voltage $V_{DD}$ while its pin 7 is connected to ground. The output pin 4 of IC6-3 is connected to the count input pin 3 of the flip flop MD5. The reset input pin 4 of the flip flop MD5 is connected to line L21. Pins 5 and 14 of MD5 are connected together to the bias voltage $V_{DD}$ while pins 6 and 7 are connected to ground. The Q output at pin 1 is connected to pin 8 of NAND gate MD4-1 and to line L29. Line L29 is an output line to the synch output circuit 40. The complimentary output of MD5 is provided at pin 2 and is connected to line L30. Line L30 serves as the input to the buffer driver circuit 242.

As will be appreciated by those skilled in the art, when the counters MD2-1 and MD2-2 reach a count of 145, the NAND gate MD4-2 is enabled, whereupon flip flop MD5 is clocked. This action causes its Q output on pin 1 to go high. The high signal is provided, via lines 29, to the buffer driver circuit 242 and the synch output circuit and starts the production of the coordination pulse. In addition, the high signal on line 29 is provided to pin 8 of the NAND gate MD4-1.

When the count reaches 150, high signals appear on pins 1 and 2 of MD4-1 from MD2-1, whereupon a low output signal appears on line L28 to the coordinator reset circuit 236. Upon receipt of this signal, the coordinator reset circuit provides a reset signal on line L21 to reset the variable cycle length generator circuit 230, the two 8 bit counters MD2-1 and MD2-2 and flip flop MD5. The coordination signal (pulse) consists of a negative going wave from $V_{DD}$ to ground with a duration of 3.3% of the duty cycle of the coordinator. The complementary output pin 2 of MD5 is connected to line L31 which serves as one input to the buffer driver and is arranged to carry a signal thereto to initiate the start of the production of the synchronizing pulse when the flip flop MD5 sets at count 145.

The coordinator reset circuit 236 basically comprises another stage MD4-3 of the quad NAND gate. Input pins 3 and 4 of NAND gate MD4-3 are connected together to line L28. Pin 14 of NAND gate MD4-3 is connected to the bias voltage $V_{DD}$ while its pin 7 is connected to ground. Output pin 6 is connected to line L21. Input pin 5 is connected to synch input line L30. Line L30 is connected to the output of the synch input circuit 238. The synch input basically comprises a pair of resistors R39 and R40 and a capacitor C17. One side of capacitor C17 is connected to line L30 and to one side of resistor R39. The other side of resistor R39 is connected to an input jack J1 and to one side of resistor R40. The other side of resistor R40 is connected to the bias voltage $V_{DD}$. The other side of capacitor C17 is connected to ground.

The synch input circuit is arranged to receive a synchronization signal from some synchronization means, e.g., another coordinator 20 constructed in accordance with the instant invention or some other means for producing a synchronizing signal at a desired time. Such latter means may comprise a manually operable push button. In preferred practice, it is desirable to use another coordinator 20 constructed in accordance with the teachings of this invention as a master coordinator for all of the controller mounted coordinators in the field. In such an application, the master coordinator is synchronized to the power grid so that it produces its synchronizing signal at the desired time. This master coordinator is then taken to each local controller and its synch output is provided as the synch input to the coordinator in that controller. Thus, when the synchronization time occurs, that is at 3.3% at time interval that the synch pulse is created, the synch signal is provided to the synch input circuit to the coordinator reset circuit 236. This action resets the constant duty cycle generator and the variable cycle length generator circuitry in the local coordinator to bring it in synchronism with the master coordinator.

Operation of the synch inputs and output circuits is as follows: as noted heretofore, when flip flop MD5 is set, the signal (pulse) begins coordination. That signal is provided via line L29 to the synch output circuit 240. The synch output circuit 240 basically comprises a two input NAND gate MD7-3, which NAND gate forms a third stage of the quad integrated circuit NAND gate. Input pins 12 and 13 of NAND gate MD7-3 are connected together to input line L29. Output pin 11 of NAND gate MD7-3 is connected to a jack J2 which serves as the output of the synch output circuit for the coordinator. It is at this jack that the synch output signal appears each time the count reaches 145. The synch output jack serves as the output point for using that coordinator as a "master coordinator" to synchronize other coordinators thereto. This is accomplished by connecting the synch output of an operating coordinator, e.g. the master coordinator, to the input jack J1 of the synch input of the slave or local coordinator. The local coordinator 20 can also be brought into synchronization without the use of another or master coordinator 20 by applying a ground signal at jack J1 of the synch input 238 by some other appropriate means, such as the manual push button mentioned heretofore. Thus, when the coordinator 20 of the instant invention is installed in a traffic light controller in the field, the coordinator can be adjusted whenever necessary by merely providing a synch input signal into jack J1.

The resistors R39 and R40 form the voltage divider for the synch input while capacitor C17 serves as a filter capacitor to remove any noise created by oontact bounce in the event the synchronization of the coordinator 20 is accomplished by a movable contact or switch connected to the synch input jack J1.

The coordination or synchronization signal (pulse) produced by the local coordinator during normal operation is provided by the flip flop MD5, via line L31 to the buffer driver circuit 242. If external coordination is provided, e.g., there is a coordination signal inputted to synch input 238, the synchronization signal provided from synch input circuit 238 is provided to the buffer driver via, line L30.

Thus, for automatic coordination the input signal to the buffer driver is provided via line L31 whereas during manual coordination, e.g., setting of the coordinator, the coordination signal is provided via line L30 to the buffer driver.

The buffer driver circuit 242 basically comprises another NAND gate MD7-4 forming a portion of the quad NAND gate, an inverter I6-4 forming another portion of the quad inverter, a pair of resistors R37 and R38, and a transistor Q1. Input pin 8 to NAND gate MD7-4 is connected to line L31 while input pin 9 is connected to line L30. The output pin 10 of MD7-4 is connected to input pin 5 of the inverter I6-4. The output pin 6 of the inverter is connected to one side of resistor R37. The other side of resistor R37 is connected to the base of transistor Q1 and to one side of a resistor R38. The other side of resistor R38 is connected to ground. The emitter of transistor Q1 is connected to ground. The collector of transistor Q1 is connected to output line L32. Line L32 serves as the input to the coordinator output relay 244. The resistors R37 and R38 form a voltage divider for biasing the base of the transistor Q1. Upon the occurrence of the synchronization pulse, that is when line L31 goes low, the transistor Q1 is turned off. The transistor's collector, as noted heretofore, is connected via line L32 to the coordination output relay 244. This relay is arranged to be in its relaxed (de-energized) state when transistor Q1 of the buffer driver is off.

The coordination output relay 244 basically comprises a conventional relay K1 having two pairs of contacts and an associated coil and a diode CR8, a resistor R25 and a capacitor C7. Line L32 is connected to one side of the relay coil and to the anode of diode CR8. The other side of the relay coil is connected to the cathode of diode CR8 and to the +12 volt supply voltage. The common contact 6 of relay K1 is connected to a movable contactor K1-1 while the common contact 9 is connected to movable contactor K1-2. Contactor K1-1 is adapted to contact either stationary contact 5 or stationary contact 7, while movable contactor K1-2 is adapted to engage stationary contact 8 or stationary contact 10, depending upon the state of energization of the relay coil.

Stationary contactor 5 of relay K1 is isolated and its associated stationary contactor 7 is connected to one side of a resistor R25 and to output line L33. The other side of resistor R35 is connected to one side of capacitor C7. The other side of capacitor C7 is connected to the common contactor 6 and to the 120 volt AC line L4. The common contact 9 of relay K1 is connected to the +12 volt bias. The stationary contact 8 of relay K1 is connected to line L34 and stationary contact 10 is isolated.

The coordination relay is turned on and off by the operation of the transistor Q1 in the buffer driver 242. In that regard, when the transistor Q1 is not conducting, the relay K1 is in the relaxed state shown in FIG. 2, that is with the contactor K1-1 bridging stationary contacts 5 and 6 and the contactor K1-2 bridging contacts 9 and 8. Thus, the relay is relaxed condition during the existence of the synchronizing signal. When the transistor Q1 conducts, that is during the 96.7% "off" portion of the duty cycle, the relay coil is energized via line L32. Accordingly, the two movable contacts K1-1 and K2-2 move to the opposite position from that shown in FIG. 2. Thus, contactor K1-1 bridges contacts 6 and 7, whereupon the 120 volt AC is provided via line L4 to line L33. When the coordinator produces the synchronization signal, the transistor Q1 in the buffer driver ceases conducting, whereupon the coordination output relay coil is deenergized so that the relay relaxes. This action removes the 120 volt AC from line L33. As noted earlier, line L33 is connected to the synchronous motor 110 within the traffic light controller 22 so that the motor is stopped and then started as described heretofore to bring it into the desired synchronization.

During the coordination or synchronization time, that is when the contactor K1-2 is in the position shown in FIG. 2B a 12 volt signal appears on line L34. This signal is used by the display circuit 246 to provide a visual signal each time the coordination pulse is produced.

The display circuit basically comprises a resistor R26 and a light emitting diode DS1. One side of resistor R26 is connected to line L34 and the other side is connected to the anode of the diode DS1. The cathode of diode DS1 is connected to ground. Accordingly, upon the relaxation of coordinating output relay 244 the 12 volt signal is provided via line L34 to the diode to effect illumination thereof.

The following table is indicative of various component values for the circuitry of the instant invention. The values for resistors and potentiometers are given in kilohms and the value of capacitors is in microfarads, unless otherwise shown. Solid state components as identified by their manufacturer and/or identification numbers:

| REF-ERENCE NO. | COMPONENT | VALUE OR MANU-FACTURER AND MODEL NO. |
|---|---|---|
| R1 | Resistor | 20 Mega ohms |
| R2 | Resistor | 3.9 |
| R3 | Resistor | 604 ohms |
| R4 | Resistor | 10 Mega ohms |
| R5 | Resistor | 237 |
| R6 | Resistor | 510 |
| R7 | Resistor | 301, 1% |
| R8 | Resistor | 162 ohms, 1% |
| R9 | Potentiometer | 100 ohms, Beckman, 89 PRO1 |
| R10 | Resistor | 499 |
| R11 | Resistor | 226 |
| R12 | Resistor | 10 |
| R13 | Resistor | 10 |
| R14 | Resistor | 300 |
| R15 | Resistor | 10 |
| R16 | Resistor | 10 |
| R17 | Resistor | 100 |
| R18 | Resistor | 301 |
| R19 | Resistor | 162 ohms, 1% |
| R20 | Potentiometer | 100 ohms, Beckman, 89 PRO1 |
| R21 | Resistor | 499, 1% |
| R22 | Resistor | 226 |
| R23 | Resistor | 10 |
| R24 | Resistor | 470 ohms |
| R25 | Resistor | 470 ohms |
| R26 | Resistor | 1 |
| R27 | Resistor | 100 |
| R28 | Resistor | 75 |
| R29 | Resistor | 10 |
| R30 | Resistor | 10 |
| R31 | Resistor | 20 |
| R32 | Resistor | 20 |
| R33 | Resistor | 20 |
| R34 | Resistor | 20 |
| R35 | Resistor | 20 |
| R36 | Resistor | 20 |
| R37 | Resistor | 20 |
| R38 | Resistor | 10 |
| R39 | Resistor | 100 |
| R40 | Resistor | 10 |
| R41 | Resistor | 1.5 Mega ohms |
| C1 | Capacitor | .22 |
| C2 | Variable Capacitor | 5 to 25 pf, Johanson |
| C3 | Capacitor | 27 pf |
| C4 | Capacitor | 220, 35V |

-continued

| REF-ERENCE NO. | COMPONENT | VALUE OR MANU-FACTURER AND MODEL NO. |
|---|---|---|
| C5 | Capacitor | .01, 25V |
| C6 | Capacitor | 3.3, 16V |
| C7 | Capacitor | .01, 1KV |
| C8 | Capacitor | .22 |
| C9 | Capacitor | .22 |
| C10 | Capacitor | .22 |
| C11 | Capacitor | 22, 25V |
| C12 | Capacitor | .22 |
| C13 | Capacitor | .22 |
| C14 | Capacitor | 3.3, 16V |
| C15 | Capacitor | .22 |
| C16 | Capacitor | .22 |
| C17 | Capacitor | .01 |
| C18 | Capacitor | .01 |
| C19 | Capacitor | .01 |
| C20 | Capacitor | .01 |
| CR1 | Diode | Fairchild, 1N4148 |
| CR2 | Diode | Fairchild, 1N4148 |
| CR3 | Diode | Fairchild, 1N4001 |
| CR4 | Diode | Fairchild, 1N4001 |
| CR5 | Diode | Fairchild, 1N4001 |
| CR6 | Diode | Fairchild, 1N4001 |
| CR7 | Diode | Fairchild, 1N4148 |
| CR8 | Diode | Fairchild, 1N4148 |
| CR9 | Diode | Fairchild, 1N5234B |
| Q1 | Transistor | Motorola, 2N4124 |
| VR | Voltage Regulator | Fairchild, 78L12ANC |
| DS1 | L.E.D. | Fairchild, FLV-117 |
| Y1 | Crystal | 1.966080 MHz; M-Tron, MP-2 |
| T1 | Transformer | Signal, ST 3-1436 |
| F1 | Fuse | 1/10 Amp, Slo-blo; Little fuse, 313.100 |
| SW1 | Switch | D.I.P. Switch, 6 position; Crayhill 76B06 |
| K1 | Relay | P & B, R10E1Y2S800 |
| MD1 | Integrated Circuit | Motorola, MC 14557BCP |
| MD2 | Integrated Circuit | Motorola, MC 14520BCP |
| MD3 | Integrated Circuit | Motorola, MC 14020BCP |
| MD4 | Integrated Circuit | Motorola, MC 14023BCP |
| MD5 | Integrated Circuit | Motorola, MC 14013BCP |
| IC6 | Inverter | Motorola, MC 14069BCP |
| MD7 | Integrated Circuit | Motorola, MC14011BCP |
| IC8 | Integrated Circuit | National Semiconductor, LM 324 |
| IC9 | Integrated Circuit | National Semiconductor, LM324 |

As will be appreciated from the foregoing, the coordinator of the instant invention is relatively simple in construction, low in cost and provides an effective means for coordinating traffic signals under various power grid conditions. Moreover, the coordinator is portable and self-powered so that it can be used as a master coordinator for quickly and easily coordinating local controller-installed coordinators.

Without further elaboration, the foregoing will so fully illustrate our invention that others may, by applying current or future knowledge, readily adapt the same for use under various conditions of service.

I claim:

1. A coordinator for a traffic signal controller including motor means and associated switching means for establishing the duty cycle of said controller, said controller being powered by AC mains connected to an electric power grid, said coordinator comprising detecting means and coordinating means responsive thereto for providing a synchronizing signal to said motor means and associated switching means during each duty cycle and in synchronization with the frequency of the alternating current provided to said controller by said AC mains, said detecting means comprising means for receiving AC signals from said mains and for receiving stray radiation having a frequency component of the frequency of said AC signal appearing on said power grid and for providing timing signals to said coordinating means, said coordinating means operating in response to said timing signals for producing said synchronizing signals based on said timing signals.

2. The coordinator of claim 1 wherein said coordinator includes a self-contained electric power source for operating said coordinator in the event that the AC power to the controller is interrupted.

3. The coordinator of claim 2 wherein said detecting means comprises filter means for filtering the power frequency signals from said stray radiation.

4. The coordinator of claim 2 wherein said coordinator also includes oscillating means for independently producing timing signals of the frequency of said AC power signals and for providing said timing signals to said coordinating means in the event that said detecting means is unable to detect the signal of said power frequency.

5. The coordinator of claim 2 wherein said coordinating means is adjustable to coincide with said duty cycle.

6. The system of claim 5 wherein said coordinating means additionally comprises digital circuit means for providing a synchronizing signal to said motor means.

7. The system of claim 1 wherein said coordinating means also comprises relay means for temporarily interrupting operation of said motor means in the event that said motor gets out of synchronization and for restarting said motor means when said synchronization signal is produced to bring said motor means back into synchronization.

8. The coordinator of claim 1 additionally comprising output means for providing said synchronizing signals to other coordinators.

9. The coordinator of claim 8 wherein said other coordinators include input means for receipt of said synchronizing signals from said master coordinator.

10. The coordinator of claim 1 wherein said coordinator includes input means for receipt of a synchronizing signal from external means.

11. The coordinator of claim 6 wherein said digital means comprise variable cycle length generator means and associated cycle length select switching means.

12. The coordinator of claim 11 wherein said digital means additionally comprises constant duty cycle generator means.

13. The coordinator of claim 7 wherein said coordinator includes a self-contained electric power source for operating said coordinator in the event that the AC power to the controller is interrupted.

14. The coordinator of claim 13 wherein said detecting means comprises filter means for filtering the power frequency signal from said stray radiation.

15. The coordinator of claim 14 wherein said coordinator also includes oscillating means for independently producing timing signals of the frequency of said AC power signals and for providing said timing signals to said coordinating means in the event that said detecting means is unable to detect the signal of said power frequency.

16. The coordinator of claim 15 wherein said coordinating means is adjustable to coincide with said duty cycle.

17. The coordinator of claim 16 wherein said coordinating means additionally comprises digital circuit means for providing a synchronizing signal to said motor means.

18. The coordinator of claim 17 wherein said coordinator additionally comprises output means for providing said synchronizing signals to other coordinators.

19. The coordinator of claim 18 wherein said other coordinators include input means for receipt of said synchronizing signals from said master coordinator.

20. The coordinator of claim 19 wherein said coordinator includes input means for receipt of a synchronizing signal from external means.

21. The coordinator of claim 20 wherein said digital means comprise variable cycle length generator means and associated cycle length select switching means.

22. The coordinator of claim 21 wherein said digital means additionally comrises constant duty cycle generator means.

* * * * *